US009302370B2

(12) United States Patent
Nadeau

(10) Patent No.: US 9,302,370 B2
(45) Date of Patent: Apr. 5, 2016

(54) DOOR KNOB INSTALLATION SUPPORT SYSTEM

(71) Applicant: Jacques Nadeau, Edmundston (CA)

(72) Inventor: Jacques Nadeau, Edmundston (CA)

( * ) Notice: Subject to any disclaimer, the term of this patent is extended or adjusted under 35 U.S.C. 154(b) by 0 days.

(21) Appl. No.: 14/679,728

(22) Filed: Apr. 6, 2015

(65) Prior Publication Data

US 2015/0292237 A1 Oct. 15, 2015

Related U.S. Application Data

(60) Provisional application No. 61/995,359, filed on Apr. 9, 2014.

(51) Int. Cl.
*B25B 5/16* (2006.01)
*E05B 17/06* (2006.01)
*B25B 5/08* (2006.01)

(52) U.S. Cl.
CPC ..... *B25B 5/163* (2013.01); *B25B 5/085* (2013.01); *B25B 5/16* (2013.01); *E05B 17/06* (2013.01)

(58) Field of Classification Search
CPC ..... B25B 5/163; B25B 5/068; B25B 5/067; B25B 5/16
USPC ..... 29/281.1, 281.6
See application file for complete search history.

(56) References Cited

U.S. PATENT DOCUMENTS 4,134,577 A * 1/1979 Price ..... A01K 97/28 269/101
4,199,060 A 4/1980 Howard
4,671,477 A * 6/1987 Cullen ..... B25B 5/006 248/122.1
4,749,176 A * 6/1988 Bradshaw ..... B25B 5/145 269/41
5,171,003 A * 12/1992 Kull ..... B25B 5/006 269/166
5,192,060 A * 3/1993 Novak ..... B25B 5/102 269/147
5,826,310 A * 10/1998 Hobday ..... B25B 5/068 24/514
5,833,359 A * 11/1998 Hollenbach ..... B25B 5/16 269/11
6,029,964 A * 2/2000 Bohl ..... B25B 5/163 269/166
6,302,386 B1 * 10/2001 Fuller ..... B25B 5/163 269/147
6,386,530 B1 * 5/2002 Marks ..... B25B 5/163 269/170
6,390,738 B1 5/2002 Fridman
6,505,391 B1 * 1/2003 Berna ..... B25B 5/003 269/166
6,848,683 B2 * 2/2005 Foshag ..... B25B 5/163 269/147
6,929,253 B2 * 8/2005 Marks ..... B25B 5/068 269/170
6,945,523 B2 * 9/2005 Degen ..... B25B 5/068 269/296
6,966,123 B1 * 11/2005 Rubino ..... B25B 5/06 269/283
6,994,498 B2 2/2006 Trettin et al.
7,073,991 B2 7/2006 Thomas
7,114,714 B2 * 10/2006 Wong ..... B23K 37/04 269/45

(Continued)

*Primary Examiner* — Lee D Wilson
*Assistant Examiner* — Jamal Daniel
(74) *Attorney, Agent, or Firm* — IP Global Patents; Andrew Alia

(57) ABSTRACT

A tool kit for holding a door knob during supporting installation or uninstallation of a door locks, the tool kit comprises a bar clamp comprising a clamp assembly mounted on a slide bar, adapted for holding an edge of a door. The slide bar extends towards an outer face of the door. The tool kit further comprises an angular bracket comprising a first arm slidably mountable on the slide bar and a second arm comprising a felt pad adapted for holding a door knob in position on the outer face of the door, upon pressing at least one locking pressure point on the angular bracket.

8 Claims, 4 Drawing Sheets

(56) References Cited

U.S. PATENT DOCUMENTS 7,134,651 B1 * 11/2006 Beck ..... B25B 5/102 269/147
7,159,858 B2 * 1/2007 Ben-Gigi ..... B25B 5/068 269/147
7,168,181 B2 * 1/2007 Walchak ..... B25B 5/068 269/36
7,210,880 B2 5/2007 Snider et al.
7,396,004 B2 * 7/2008 Kern ..... B25B 5/003 269/3
7,398,966 B2 * 7/2008 Hubbard ..... B25B 5/068 269/155
7,530,770 B2 5/2009 Chao
7,546,996 B2 * 6/2009 Somji ..... F16M 11/045 248/229.14
7,641,183 B2 * 1/2010 Fuller ..... B25B 5/068 269/3
7,798,478 B2 * 9/2010 Janson ..... B25B 5/006 269/166
8,020,840 B2 * 9/2011 Hall, Jr. ..... B23K 37/0435 269/3
8,079,577 B2 * 12/2011 Simon ..... B25B 5/068 269/3
8,087,649 B2 * 1/2012 Duss ..... B25B 5/163 269/216
8,282,088 B2 * 10/2012 Janson ..... B25B 5/006 269/143
8,313,095 B2 * 11/2012 Kloepfer ..... B25B 5/102 269/143
8,443,523 B2 5/2013 Lam et al.
8,702,077 B2 * 4/2014 Liu ..... B25B 5/102 269/165
8,763,998 B1 * 7/2014 Worstell ..... B25B 5/068 269/6
8,827,251 B2 * 9/2014 Kuo ..... B25B 5/163 269/3
9,144,890 B2 * 9/2015 Chen ..... B25B 5/085
9,156,138 B1 * 10/2015 Prescott ..... B25B 5/068
2004/0040127 A1 * 3/2004 Hellkamp ..... B25B 5/068 24/460
2005/0121842 A1 * 6/2005 Lo ..... B25B 5/163 269/6
2007/0041800 A1 2/2007 Santos
2009/0146354 A1 * 6/2009 Metroyanis ..... E04G 21/1891 269/43
2010/0156015 A1 * 6/2010 Klein ..... B25B 5/163 269/166
2010/0327504 A1 * 12/2010 Seidel ..... B25B 5/003 269/43
2011/0001022 A1 * 1/2011 Edinger ..... A61G 13/101 248/103
2011/0227269 A1 * 9/2011 Zheng ..... B25B 5/068 269/285
2014/0001691 A1 * 1/2014 Royal ..... B25B 5/003 269/45
2014/0064867 A1 3/2014 Trettin
2014/0124999 A1 * 5/2014 Foss ..... B25B 5/003 269/276
2014/0133929 A1 5/2014 Smith
2014/0252711 A1 * 9/2014 Tropea ..... B25B 1/06 269/90
2014/0265085 A1 * 9/2014 Albin ..... B25B 5/127 269/6
2015/0246431 A1 * 9/2015 Shute ..... B25B 5/163 144/195.4
2015/0343607 A1 * 12/2015 Wang ..... B27B 27/10 269/249
2015/0375369 A1 * 12/2015 Noniewicz ..... F16B 2/185 24/528

* cited by examiner

DOOR KNOB INSTALLATION SUPPORT SYSTEM

FIELD OF THE INVENTION

The present invention generally relates to installation of door locking devices, and more particularly relates to a tool kit for supporting installation and/or uninstallation of a door lock including door knobs, door lever, deadbolt and the like.

BACKGROUND OF THE INVENTION

Installation of door locks typically involves determining a suitable position for mounting a door lock comprising door knobs or levers on a door and drilling holes for door knob or door lever and latch assembly using a drill template, followed by mounting the latch assembly and then securing door knobs on either side of the door. It is generally required to hold door knobs on both sides of the door during installation or uninstallation of door knobs.

Holding a door knob on one side of the door while assembling or dismantling a door knob on other side may be difficult or even frustrating, especially for people who perform the above task for the first time and for people who are not skilled in performing such tasks. Moreover, holding both the knobs on either side of the door at the same time while installing or uninstalling door locks may be difficult to perform and time consuming in many instances. This may also result in incomplete or inaccurate installation of door locks on the door.

Existing devices that aids in door lock installation includes tool kits for locating door holes and drill guides or templates for drilling holes on specific marked areas during installation. From the prior art, for example, U.S. Pat. No. 8,443,523 B2 shows a tool kit for locating a door lock in relation to a strike plate. U.S. Pat. No. 6,954,989 B1 deals with a door operating hardware installation guide comprising templates on front and sides. Further US patent publication numbers 2014/0133929, 2014/0064867 and 2007/0041800 discloses a variety of devices for locating and pre-boring holes on the door prior to installation of door locks. None of the above references deals with a supporting device or a tool kit for secure holding of a door knob in its position during installation or uninstallation.

Therefore there still exists a need for a third hand helper kit or a door knob installation support system for holding door locks including knobs or levers in position during installation or uninstallation of door locks.

SUMMARY OF THE INVENTION

The present invention relates to a tool kit for holding a door knob in position during installation or uninstallation of a door lock assembly, the tool kit comprises a bar clamp comprising a clamp assembly mounted on a slide bar, adapted for holding an edge of a door, wherein the slide bar extends towards an outer face of the door. An angular bracket with two arms bent in opposite angles, comprising a first arm slidably mountable on the slide bar and a second arm adapted for holding a door knob in position, upon gently pressing the a pressure point on the bracket. The second arm comprises a felt pad affixed to an inner surface, the bracket is slidable over the slide bar for positioning the second arm such that the felt pad firmly presses against an exterior surface of the door knob.

The angular bracket comprises a metal plate such as a steel plate with at least one hole adapted to slide the bracket over the slide bar for positioning the felt pad against the outside door knob (door knob on the outer face of the door) during operation of the tool. The bracket further comprises a plurality of holes adapted to slide the bracket over the slide bar of bar clamp during storage of the tool kit.

DETAILED DESCRIPTION OF THE INVENTION

The following detailed description of the preferred embodiments presents a description of certain specific embodiments to assist in understanding the claims. However, the present invention is intended to cover alternatives, modifications and equivalents, which may be included within the spirit and scope of the invention as defined by the appended claims.

The terms "door knob" and "door lock" are used interchangeably herein. Door locks comprises door knob, door lever, deadbolt and similar locking devices or hardware for securing doors.

The door knob installation support system of the present invention comprises a tool kit for supporting door lock installation by securely holding a door knob on a first side of the door while assembling or dismantling a door knob on a second side of the door. Preferably, by holding the door knob on outer face of the door (outside door knob) using the tool kit, the installer's hands are free to install or uninstall the door knob on inner face of the door (inside door knob).

Figure 1A:
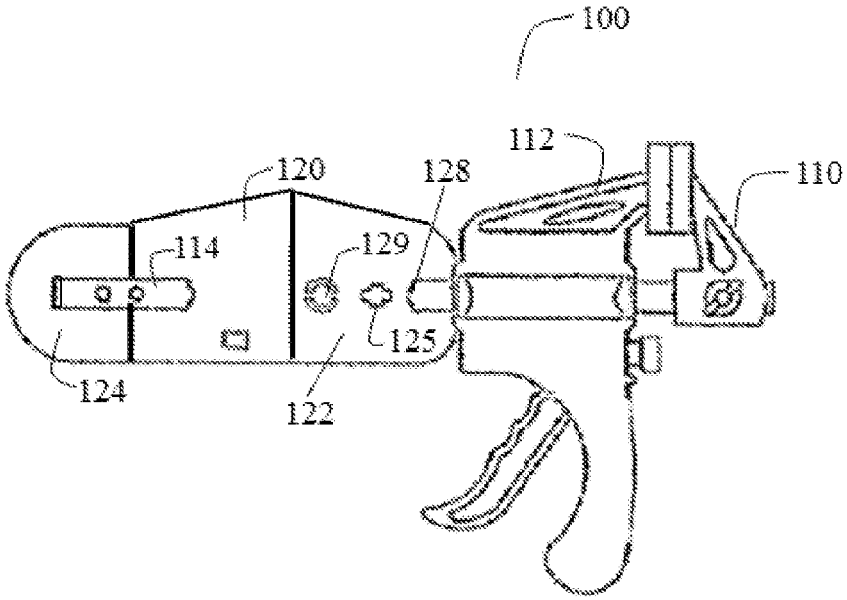
FIG. 1A and 1B shows a side view and top view of the tool kit respectively, according to an embodiment of the present invention.
Figure 1B:
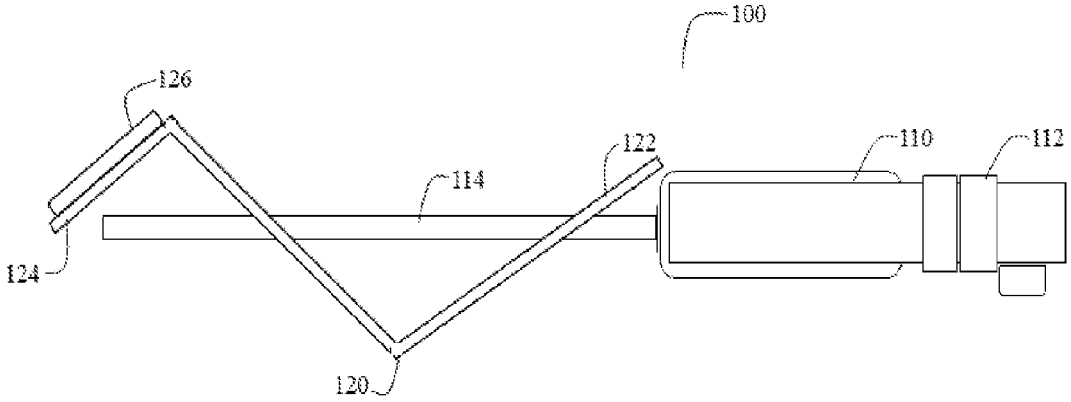

Referring to FIG. 1A and 1B, respectively illustrates a side view and a top view of the tool kit for supporting door lock installation or uninstallation, according to an embodiment of the present invention. The tool kit 100 comprises two components namely a bar clamp 110 and an angular bracket 120 slidably mountable on the bar clamp 110 for holding a door knob on outside or outer face of the door. The bar clamp comprises a clamp assembly 112 mounted on a slide bar 114 positioned to extend towards an outer face of the door. The angular bracket 120 comprises two ends or two arms bended in opposite angles, a first arm 122 slidably mounted on the slide bar 114 and a second arm 124 comprising a felt pad 126 positionable for pressing against a door knob in order to hold it in position on the outer face of the door. The angular bracket 120 further comprises a plurality of holes 128, which facilitates sliding movement of the bracket 120 over the slide bar 114 during storing the tool kit. The angular bracket comprises at least one hole 125 for sliding over the slide bar 114 when the tool is in use. Further, at least one pressure point 129 is present on the angular bracket 120 for pressing or exerting locking pressure on the bracket upon positioning the felt pad 126 against the door knob. Upon pressing the pressure point 129, the angular bracket holds the door knob on the outer face of the door during assembling or dismantling door knob on the inner face of the door.

In an embodiment, the angular bracket 120 is slide over the slide bar 114 for positioning the second arm adjacent to the door knob and by pressing the pressure point 129, the felt pad 126 on the second arm 124 is pressed firmly against the door knob, holding it in place. With the door knob on one side of the door firmly held by the tool kit 100, a door knob can be fitted to the other side of the door with ease.

Figure 2A:
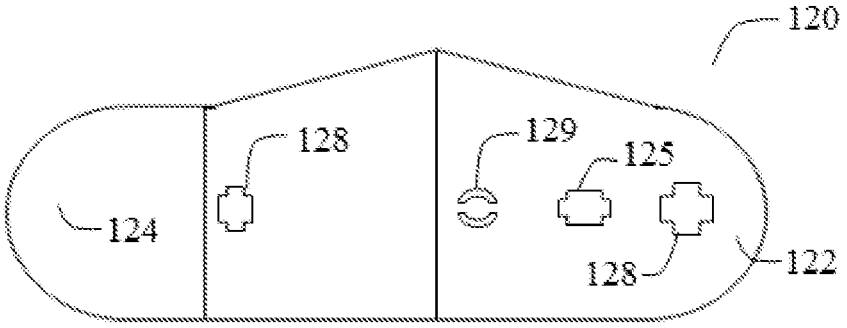
FIG. 2A and 2B shows a side view and a top view of the angular bracket of the tool kit.
Figure 2B:
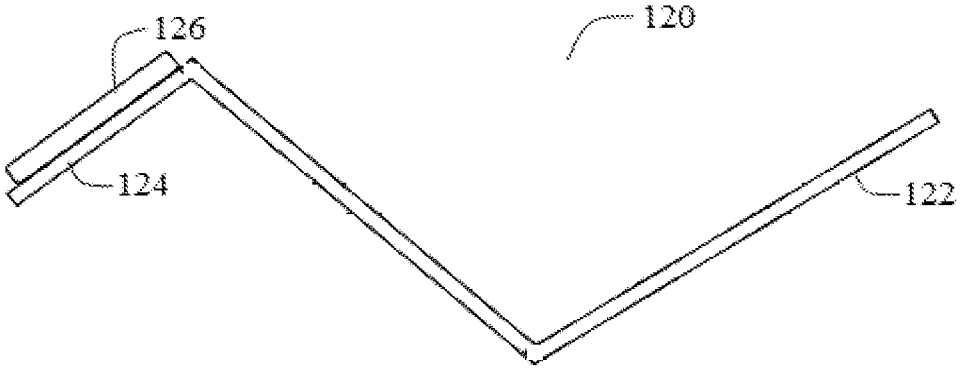

FIG. 2A and 2B illustrates a side view and a top view of the angular bracket respectively. The angular bracket 120 comprises a first arm 122 and a second arm 124 bent at opposite angles to each other. In an embodiment, the two arms 122 and 124 are bended in opposite directions at a right angle to the main body. In another embodiment, the two arms 122 and 124 are bended in opposite directions at an obtuse angle to the main body. The second arm 124 comprises a felt pad 126 attached to an inner surface of the bracket 120 facing the door knob, the felt pad 126 can be configured in different shapes according to the door lock type and further may comprise an adhesive layer or a self-sticking layer.

In an embodiment, the angular bracket 120 is made of a metal such as steel, which enables firm holding of the door knob. The bracket 120 comprises a plurality of holes or apertures 128 adapted for sliding the bracket 120 over the slide bar of the bar clamp during storage of the tool kit. Further comprises the hole 125 adapted for sliding the bracket 120 over the slide bar during operative usage of the tool. The pressure point 129 comprises a laser cut provision for exerting a gentle locking pressure on the bracket in order to press the felt pad 126 against the door knob for secure holding of the door knob in position. In an embodiment, the pressure point is located adjacent to the bending edge of the first arm 122.

Figure 3A:
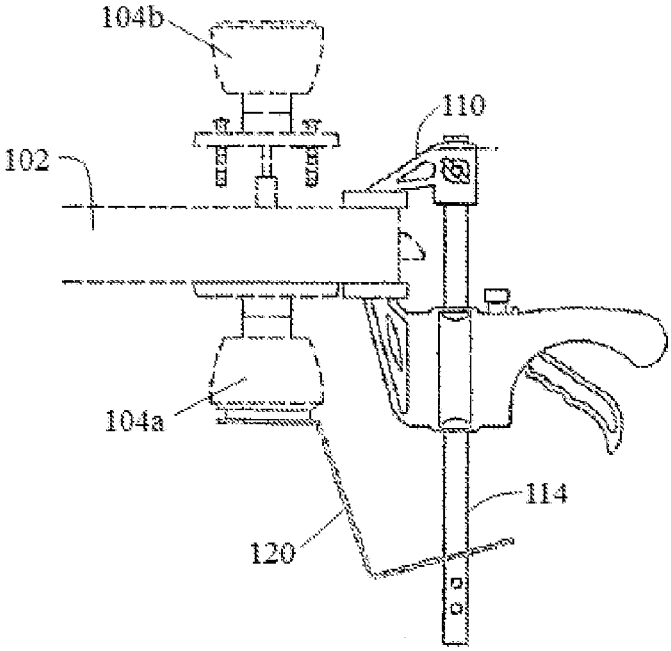
FIG. 3A-3C shows the tool kit holding different types of door locks.
Figure 3B:
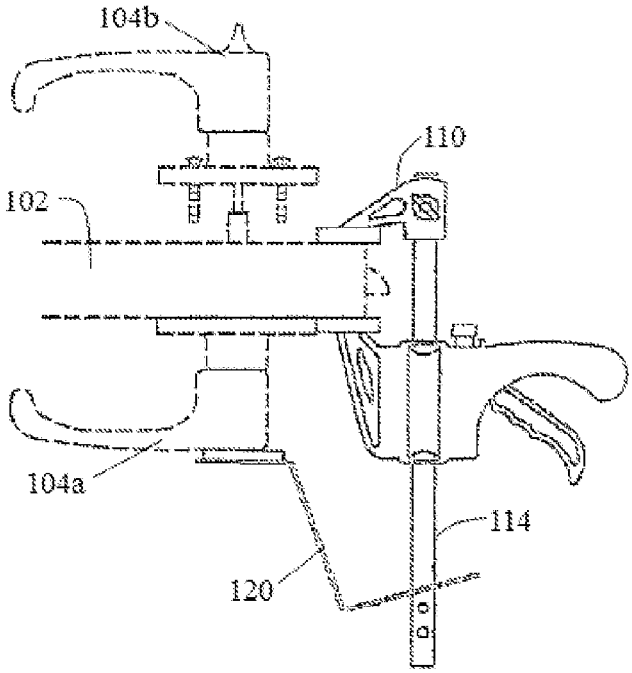
Figure 3C:
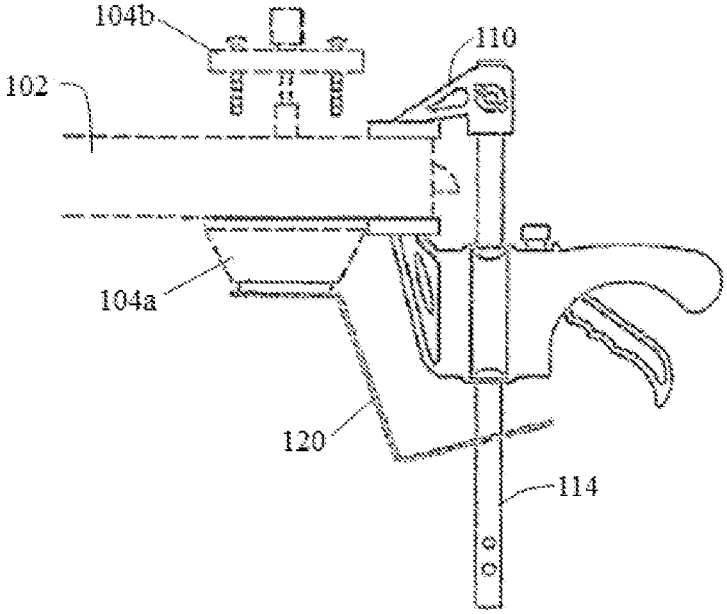

FIG. 3A-3C shows top views of the tool kit being used for holding different types of door locks. The tool kit is shown comprising the bar clamp 110 used for holding an edge of the door 102. The tool kit enables fitting a second door knob to inner side of the door while securely holding a first door knob to the outer side of the door, according to an embodiment of the present invention. FIG. 3A shows fitting a door knob to an inner side of a door while holding a door knob on the outer side of the door using the tool kit. Similarly FIG. 3B shows fitting of a second door lever to the inner side of the door while holding a first door lever on the outer side using the tool kit. FIG. 3C shows fitting of a second door lock to the inner side of the door while holding a first door lock on the outer side of the door using the tool kit.

The angular bracket 120 is slidably mounted over the slide bar 114 to position the second arm with felt pad against a door knob 104*a* on a first side of the door 102 for securely holding the knob 104*a* thus allowing easy fitting or dismantling of a door knob 104*b* on the second side of the door 102.

In an embodiment, the tool kit is adapted to hold or secure a door knob on outer side of a door in its location, only after mounting the latch assembly to the door. The tool kit also can be referred to as a third hand helper kit, as the tool kit allows an installer/operator to free up his both hands, which can be used for fixing a door knob on the inner side of the door. The tool kit eliminates the need to hold up a door knob on one side of the door using a first hand while simultaneously mounting the other door knob on the second side using a second hand.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

The invention claimed is:

1. A tool kit for supporting installation or uninstallation of a door knob, the tool kit comprising:

a bar clamp comprising a clamp assembly mounted on a slide bar, adapted for holding an edge of a door, wherein the slide bar extends towards an outer face of the door;

an angular bracket with two arms bent in opposite angles comprising a first arm slidably mountable on the slide bar and a second arm comprising a felt pad adapted for holding a door knob in position, upon pressing the bracket.

2. The tool kit of claim 1, wherein the angular bracket comprises at least one hole adapted for sliding the angular bracket over the slide bar during usage of the tool kit.

3. The tool kit of claim 1, wherein the felt pad comprises an adhesive layer.

4. The tool kit of claim 1, wherein the angular bracket comprises at least one locking pressure point adapted for pressing the bracket.

5. The tool kit of claim 1, wherein the angular bracket comprises a reverse angle bracket.

6. The tool kit of claim 1, wherein the angular bracket is made up of steel material.

7. The tool kit of claim 1, wherein the angular bracket comprises a plurality of holes adapted for sliding the angular bracket over the slide bar during storage of the tool kit.

8. The tool kit of claim 1, is adapted to hold in position a door knob fixed to the outer face of the door.

* * * * *